US006357585B1

(12) United States Patent
Shin

(10) Patent No.: US 6,357,585 B1
(45) Date of Patent: Mar. 19, 2002

(54) GOLF BAG INSERT

(76) Inventor: Brian Byung Woo Shin, 2500 White Rd., Irvine, CA (US) 92714

( * ) Notice: Subject to any disclaimer, the term of this patent is extended or adjusted under 35 U.S.C. 154(b) by 0 days.

(21) Appl. No.: 08/947,795

(22) Filed: Oct. 8, 1997

Related U.S. Application Data

(63) Continuation-in-part of application No. 08/779,137, filed on Jan. 6, 1997.

(51) Int. Cl.[7] ..... A63B 55/04
(52) U.S. Cl. ..... 206/315.6; 206/315.8
(58) Field of Search ..... 206/315.2, 315.8

(56) References Cited

U.S. PATENT DOCUMENTS

| | | | | | |
|---|---|---|---|---|---|
| 936,698 | A | | 10/1909 | Breakspear | 206/315.6 |
| 1,840,183 | A | | 1/1932 | Blitch | 206/315.6 |
| 2,879,819 | A | | 3/1959 | Turnbull | 206/315.4 |
| 2,938,559 | A | * | 5/1960 | Harkrader | 206/315.2 |
| 3,101,108 | A | * | 8/1963 | Ingoldt | 206/315.6 X |
| 3,331,419 | A | | 7/1967 | Bencriscutto | 206/315.6 |
| 3,554,255 | A | | 1/1971 | Mangan | 206/315.6 |
| 3,674,072 | A | * | 7/1972 | Shuto | 206/315.3 |
| 3,941,398 | A | | 3/1976 | Nelson | 206/315.6 X |
| 4,055,207 | A | | 10/1977 | Goodwin | 206/315.6 |
| 4,182,391 | A | | 1/1980 | Kjose | 206/315.5 |
| 4,241,774 | A | | 12/1980 | Pell | 206/315.6 |
| 4,332,283 | A | | 6/1982 | Rader | 206/315.6 |
| 4,383,563 | A | | 5/1983 | Kirchhoff, Jr. | 206/315.5 X |
| 4,779,725 | A | * | 10/1988 | Gerber | 206/315.6 X |
| 4,944,396 | A | | 7/1990 | Larkin | 206/315.6 |
| 4,988,216 | A | | 1/1991 | Lyman | 383/24 |
| 5,096,059 | A | | 3/1992 | Henderson | 206/315.5 |
| 5,099,898 | A | | 3/1992 | Miller | 150/160 |
| 5,125,507 | A | * | 6/1992 | Graziano, Jr. | 206/315.6 |
| 5,135,107 | A | | 8/1992 | Ingraham | 206/315.6 |
| 5,190,376 | A | | 3/1993 | Book | 383/4 |
| 5,222,598 | A | | 6/1993 | Yamazoe | 206/315.5 |
| 5,226,533 | A | | 7/1993 | Antonious | 206/315.6 |
| 5,228,566 | A | | 7/1993 | Shenoha | 206/315.6 |
| 5,311,987 | A | * | 5/1994 | Shin | 206/315.6 |
| 5,431,278 | A | | 7/1995 | Gretz | 206/315.6 |
| 5,458,240 | A | | 10/1995 | Rich et al. | 206/315.6 X |
| 5,634,557 | A | * | 6/1997 | Shin et al. | 206/315.6 |
| 5,671,843 | A | * | 9/1997 | Sutter | 206/315.6 |

FOREIGN PATENT DOCUMENTS

| | | | | |
|---|---|---|---|---|
| CA | 2048177 A | | 1/1993 | |
| FR | 720869 | * | 2/1932 | 206/315.3 |
| GB | 2 130 102 A | | 5/1984 | 206/315.6 |

* cited by examiner

*Primary Examiner*—Allan N. Shoap
*Assistant Examiner*—Tri M. Mai
(74) *Attorney, Agent, or Firm*—John J. Connors; Connors & Associates

(57) ABSTRACT

An insert for a golf bag is adapted to be removably inserted into an open end of a golf bag. The insert includes a wall structure adapted to fit snugly within the open end upon insertion. The wall structure comprises a plurality of walls forming a plurality of substantially rectangular golf club receptacles arranged in at least four separate rows. The wall structure has a first element of a two-element locking mechanism which interlocks upon insertion of the insert into the open end of the golf bag. The second element of the two-element locking mechanism is located at the open end of the golf bag. The insert is formed from a polymeric material which is a soft, pliable, deformable and resilient, enabling a user to grip the unitary wall structure and deform it to disengage the elements of the locking mechanism and remove the insert from the open end of the golf bag.

33 Claims, 8 Drawing Sheets

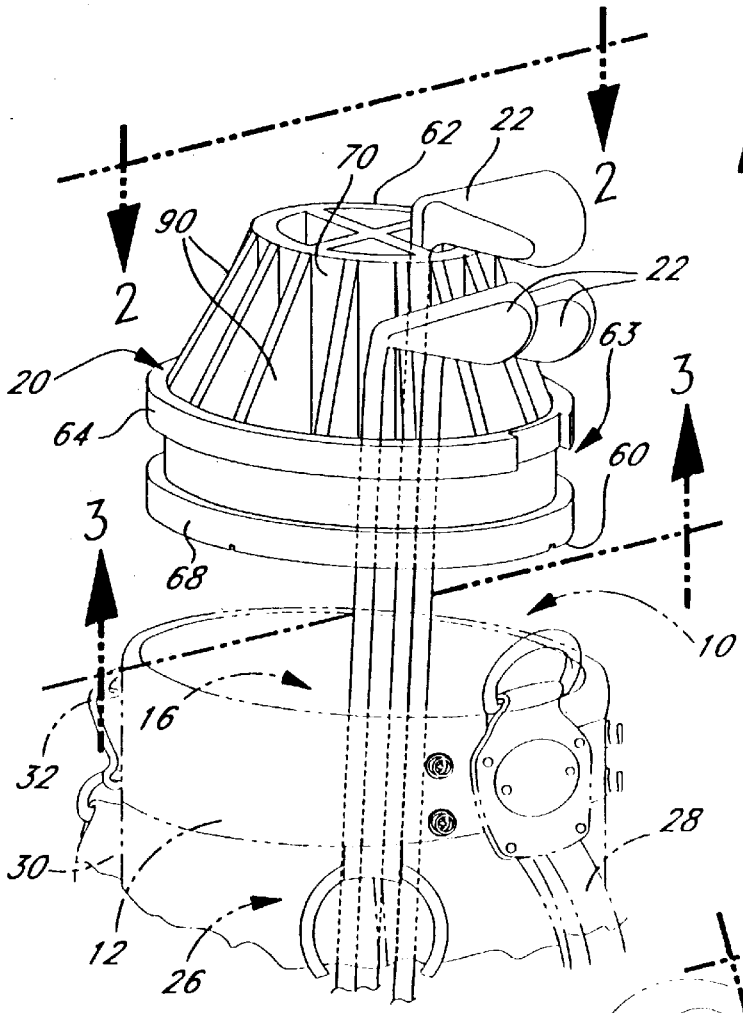
FIG. 1
FIG. 2
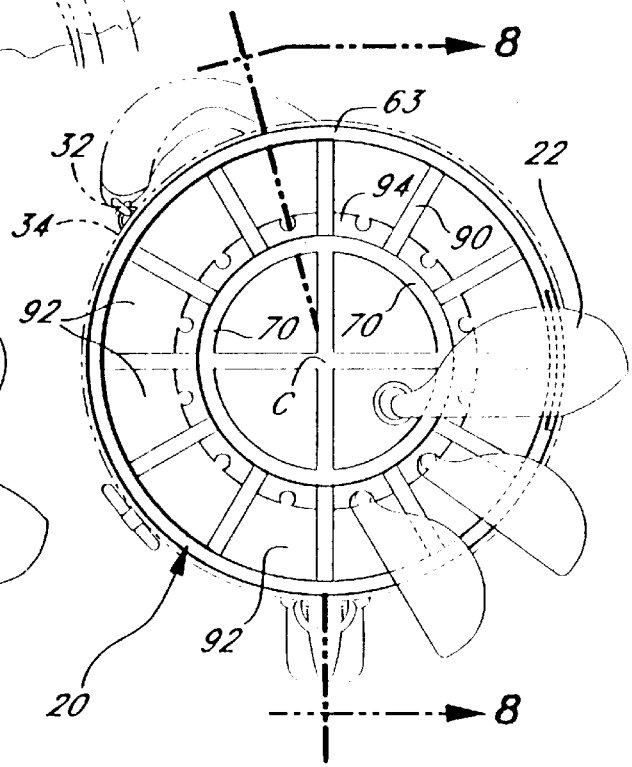
FIG. 3
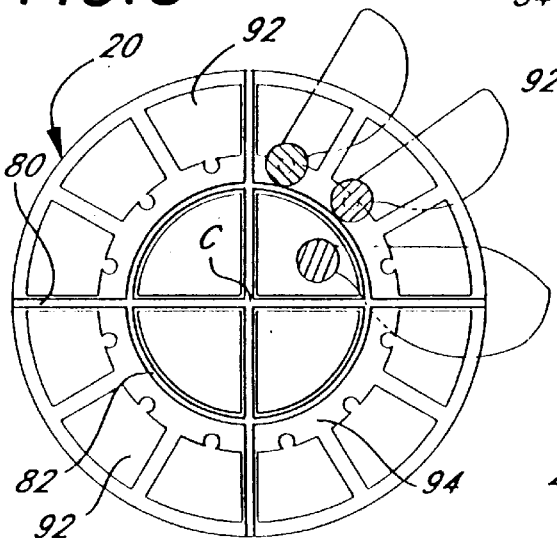

GOLF BAG INSERT

RELATED PATENT APPLICATIONS

This application is a continuation-in-part application of U.S. Ser. No. 08/779,137, entitled "Golf Bag For Protecting Golf Club Shafts," filed Jan. 6, 1997. This related application is incorporated herein by reference and made a part of this application.

BACKGROUND OF THE INVENTION

1. Field of the Invention

This invention relates to golf bags, and in particular to an insert adapted to be placed in the open end of a golf bag for holding individual golf clubs spaced apart from each other.

2. Background Discussion

Golf bags come in a wide variety of configurations, and some of them include divider elements which segregate the interior cavity of the golf bag into sections for holding individual golf clubs. Many of these golf bags are of extremely complex configurations, and they fail to protect adequately the shafts of golf clubs. This is particularly important in connection with graphite shafts which are easily damaged. In U.S. Pat. Nos. 5,624,028, and 5,634,557, there are disclosed foam receptacles or inserts designed to prevent damage to golf club shafts.

Commonly such foam inserts typically they are made of a polymeric foam material such as polyurethane, and include a number of separate compartments in which individual golf clubs are placed. Frequently, these inserts collect dirt or other debris on the surface of the insert. One way to clean the dirt and debris from the insert is to remove it from the golf bag and wash it. One disadvantage of conventional inserts is that they are difficult to remove from the open end.

SUMMARY OF THE INVENTION

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include ease of manufacture, avoidance of damage to shafts and grips of golf clubs, easy removal and reinsertion of the insert of this invention.

The first feature of the insert of this invention is that it is adapted to be removably inserted into an open end of the golf bag, and it includes a unitary wall structure having a central longitudinal axis and a plurality of walls. The insert is formed by a conventional molding process from a polymeric material, preferably a soft, pliable, deformable, resilient polyurethane foam. The walls form four rows of receptacles into which the shafts of golf clubs are placed. Three of these rows in sequence each have four receptacles therein and the fourth row has two receptacles therein. The receptacles are formed by wall members having inwardly tapered segments which reduce the likelihood of interference with grips on shafts of golf clubs as a club is withdrawn from a receptacle. The majority of the central receptacles have a substantially rectangular configuration. The term rectangular configuration is intended to include a square configuration, since a square is a special case of a rectangular. The walls include:

(a) a peripheral wall with opposed side portions, (b) first, second, and third internal walls spaced apart substantially parallel to each other and extending between opposed side portions of the peripheral wall, (c) a central internal wall which is disposed substantially at a right angle to the first, second, and third internal walls and extending between opposed side portions of the exterior peripheral wall, and (d) first and second intermediate walls.

The second feature is that the insert has an underside and a top surface with first, second, third, and fourth planar zones. Each one of the four rows of receptacles is in one of the planar zones and each receptacle has an entry-exit end lying in one of the planar zones. The first planar zone slants upward from the first side portion of the peripheral wall and terminates at the second planar zone. The second planar zone provides an apex region. The third planar zone slants downward from this apex region and terminates at the fourth planar zone. The fourth planar zone has an outer edge terminating at a second side portion of the peripheral wall which is opposite the first side portion. The first planar zone is at an angle of from 20 to 35 degrees with respect to the central longitudinal axis. The second planar zone is substantially at a right angle with respect to the central longitudinal axis. The third planar zone is at an angle of from 20 to 35 degrees with respect to the central longitudinal axis. And the fourth planar zone is substantially at a right angle with respect to the central longitudinal axis, varying a few degrees and being slightly rounded. The distance between the underside of the insert and the second planar zone is at a maximum and the distance between the underside of the insert and the fourth planar zone is at a minimum. Typically, the distance between the underside of the insert and the first planar zone is from about 2.5 to about 3 inches, the distance between the underside of the insert and the second planar zone is from about 3 to about 4 inches, and the distance between the underside of the insert and the fourth planar zone is from about 1.5 to about 2.0 inches.

The third feature is that the peripheral wall is shaped and sized substantially the same as the open end, so that upon insertion into this open end, it fits snugly therein. This peripheral wall has an outer surface with an indentation therein providing a space for a strap connection on the golf bag. In a preferred embodiment of this invention, the peripheral wall has a generally triangular configuration with rounded corners and outwardly bowed sides. In most instances, the peripheral wall encloses an area of from 50 to 70 square inches, and the receptacles provide an open space with a total area of from 35 to 60 square inches. In other words the open space exceeds 70% of the total area of the top surface of the insert.

The fourth feature is that the first intermediate wall is disposed on one side of the central internal wall and spaced from this central internal wall and the second intermediate wall is disposed on the other side of the central internal wall and spaced from the central internal wall. These first and second intermediate walls are substantially parallel to each other and to the central internal wall and they extend from a first side portion of the peripheral wall and intersect the first, second, and third internal walls at substantially a right angle. The first and second intermediate walls each have one end terminating at the first side portion of the peripheral wall and another end terminating at the third internal wall. The third internal wall is furthest from said first side portion.

The fifth feature is that the insert is locked in position at the open end of the golf bag and support on a frame. There is on the peripheral wall a first element of a two-element locking mechanism which, upon insertion of the insert into the open end of the golf bag, interlocks with a second element of the two-element locking mechanism located at the open end. Since the insert is made of a material which is soft, pliable, deformable and resilient, a user simple grips the unitary wall structure and deforms it to disengage the first and second elements of the two-element locking mechanism and remove the insert from said open end. To place the insert in the open end, the user simply pushes it downward into the open end to engage the first and second elements of the two-element locking mechanism, with the underside of the insert resting on the frame. The underside includes channels and the frame fits into and is received within the channels upon placing the insert into said open end of the bag body. In a preferred embodiment of the invention, a liner member extends from the frame lengthwise downward into a cavity in the body of the golf bag. This liner member has a plurality of liner compartments aligned with the receptacles, so that upon placing a shaft of a club into a receptacle and then into the cavity, the shaft is received in one of the liner compartments.

The sixth feature is that the distance between the first and second internal walls is approximately equal to the distance between the second and third internal walls, and the first and second intermediate walls are approximately equidistance from the central internal wall.

BRIEF DESCRIPTION OF THE DRAWING

The preferred embodiments of this invention, illustrating all its features, will now be discussed in detail. These embodiments depicts the novel and non-obvious insert and golf bag of this invention as shown in the accompanying drawing, which is for illustrative purposes only. This drawing includes the following figures (FIGS.), with like numerals indicating like parts:

FIGS. 1 through 8 illustrate the first embodiment of this invention where:

FIG. 1 is a fragmentary, exploded perspective view showing the first embodiment of the insert of this invention being inserted into the open end of the bag body of a golf bag.

FIG. 2 is a plan view taken along line 2—2 of FIG. 1.

FIG. 3 is a cross-sectional view of the underside of the first embodiment of the insert taken along line 3—3 of FIG. 1.

FIG. 4 is an exploded perspective view, with sections broken away, showing the first embodiment of the insert, the connector section, and liner.

FIG. 5 is a perspective view of the assembled connector section and liner used in the golf bag of this invention.

FIG. 6 is a cross-sectional view taken along line 6—6 of FIG. 7, with the first embodiment of the insert separated from the connector section.

FIG. 7 is a fragmentary, exploded perspective view of the first embodiment of the insert being inserted into the connector section.

FIG. 8 a cross-sectional view taken along 8—8 of FIG. 2, showing the upper portion of the fabric forming the walls of the liner folded as they would be when wrapped around the frame.

FIG. 9 is an exploded, perspective view of a golf bag using the second embodiment of the insert of this invention.

FIG. 10 is a cross-sectional view showing the second embodiment of the insert being inserted into the open end of the golf bag.

FIG. 11 is a cross-sectional view similar to that shown in FIG. 10, with the second embodiment of the insert placed in the open end of the golf bag.

FIG.12 is a plan view taken along line 12—12 of FIG. 9.

FIG. 13 is a plan view looking into the open end of the golf bag prior to the second embodiment of the insert being placed into this open end, thereby showing the liner including frame which supports the insert.

FIG. 14 is a plan view of the underside of the second embodiment of the insert of this invention.

DETAILED DESCRIPTION OF THE PREFERRED EMBODIMENTS

First Embodiment

Figure 4:
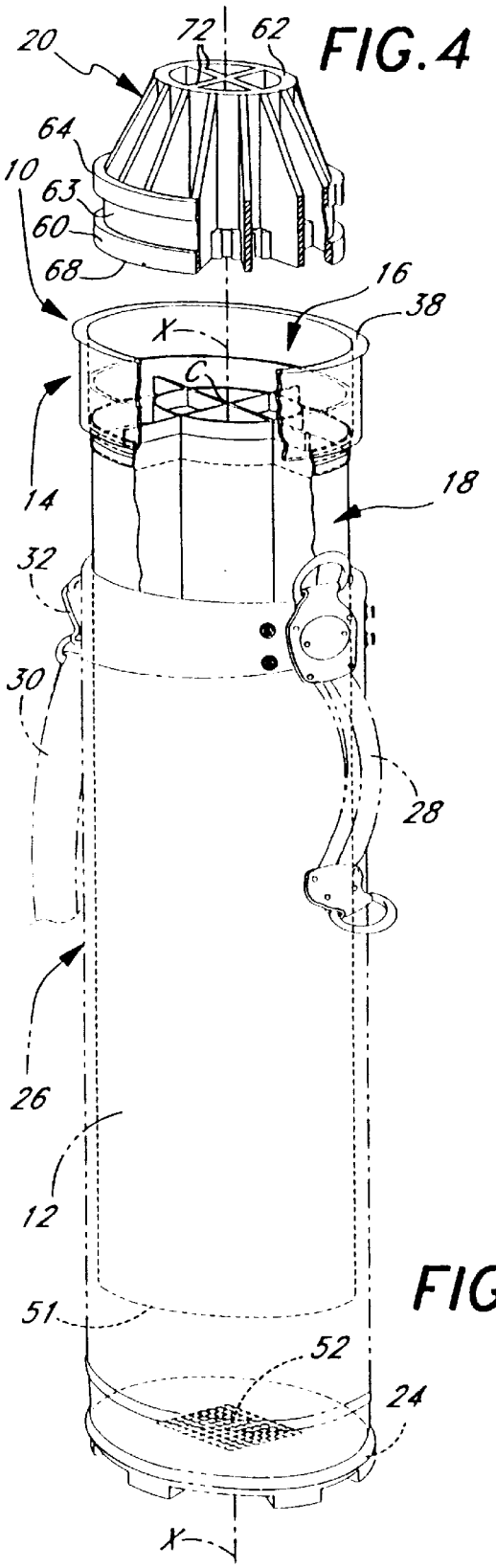

As best shown in FIGS. 1–4, the golf bag 10 of this invention includes a bag body 12, a connector section 14 (FIG. 4) near an open end 16 of the bag body 12, a liner 18 (FIG. 4) attached to the connector section 14, and a insert 20 extending out from the open end 16 and holding golf clubs 22. The bag body 12 has a substantially cylindrical configuration with a closed bottom end 24 (FIG. 4) and the open end 16, and a side wall 26 connecting the open end 16 and closed bottom end 24. The side wall 26 and closed end 24 form a cavity having an open mouth (the end 16) into which the golf clubs 22 are inserted with their shafts extending lengthwise in the cavity. A handle 28 is on one side of the bag body 12, and a strap 30 is on the other side of the bag body opposite the handle. The strap 30 has one end connected by a ring 32 to a loop element 34 (FIG. 2) riveted next to the open end 16.

Figure 7:
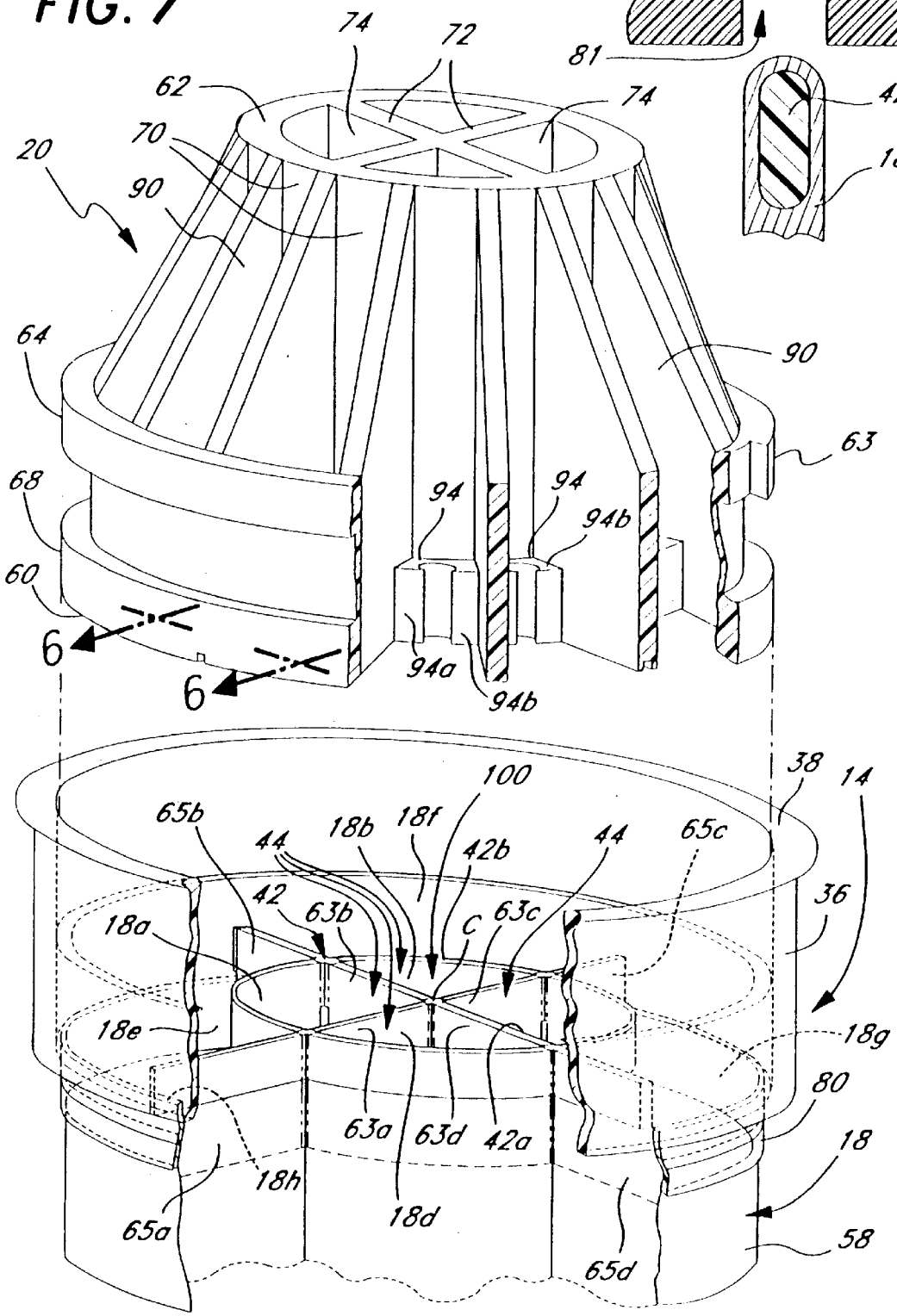

As best shown in FIG. 7, the connector section 14 has a substantially hollow, cylindrical configuration with a side wall 36 having an upper rim 38 that engages the edge of the bag body 12 forming the open end 16 when the connector section is pushed into the open mouth of the cavity of the bag body 12. An internal lip 40 extends along the inside of the connector section 14 which serves as a locking element (to be explained in greater detail subsequently), which interlocks with the insert 20. There is a frame 42 that is integral with the inside surface of the side wall 36 of the connector section 14. This frame 42 has two main components that are integral with each other: a cross-shaped component 42*a* and a circular component 42*b*. The center C of the circular component 42*b* is coincident with the point where the arms of the cross component 42*a* intersect, and the central longitudinal axis X of the bag body 12. The circumference of the circular component 42*b* intersects with each arm of the cross component 42*a* about midway between the side wall 36 and the center C. There are four wedge shaped openings 44 formed by the intersection of the cross component 42*a* and circular component 42*b* of the frame 42. This integral frame 42 is displaced inward from the rim of the connector section 14. The lip 40 is spaced apart above and adjacent to the frame 42. As will become apparent from the subsequent description, this arrangement permits the insert 20 to be locked in a fixed position to the connector section 14 and supported by the frame 42.

Figure 5:
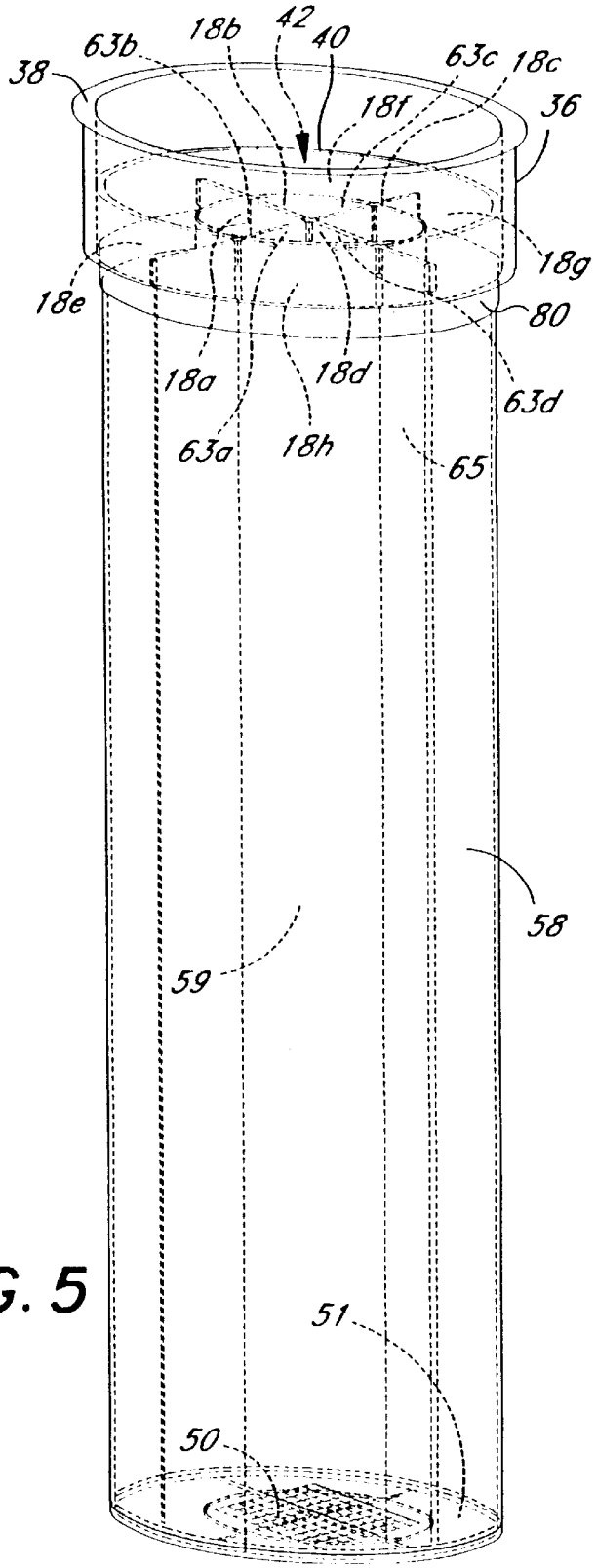
Figure 6:
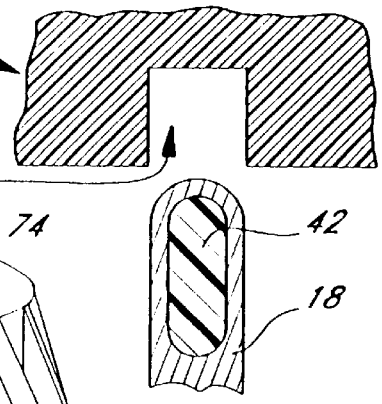

As best illustrate in FIG. 5, the liner 18 extends lengthwise from the frame 42, terminating near or at the closed bottom end 24 of the bag body 12. The liner 19 includes an outer wall section 58 and a concentric inner wall section 59 which are both of a generally cylindrical configuration. One component 50 (FIG. 5) of a hook and fabric fastener is attached to the exterior of a circular bottom fabric piece 51 sewn, or otherwise connected, to the lower ends of the wall sections 58 and 59. The other component 52 of the hook and fabric fastener is attached to the inside wall of the closed bottom end 24 of the bag body 12, so that when the liner 18 is inserted into the cavity of the bag body 12, the two components of the hook and fabric fastener interlock. Velcro Corporation makes a suitable hook and fabric fastener. The outer wall section 58 of fabric is sewn, or otherwise attached, to a circular band 80 which has a diameter slightly less than the inside diameter of the connector section 14. The band 80 is positioned to be concentric with the center C and is sewn, or otherwise connected, to the connector section 14. The inner wall section 59 hangs downward from the circular component 42*b* of the frame 18.

The liner 18 has four inner compartments 18*a*, 18*b*, 18*c*, and 18*d* and four outer compartments 18*e*, 18*f*, 18*g*, and 18*h*. The four inner compartments 18*a*, 18*b*, 18*c*, and 18*d* are formed by fabric creating divider walls 63*a*, 63*b*, 63*c*, and 63*d* which hang from the inner portions of the cross component 42*b* of the frame 18, extending throughout the length of the bag body 12, and terminating at or near the circular bottom fabric piece 51. Each divider wall 63*a*, 63*b*, 63*c*, and 63*d* has an upper section 100 (FIG. 8) which is wrapped around the inner portions of the cross component 42*b* of the frame 18, and then sewn in position along the dotted line 102. These four separate inner compartments 18*a*, 18*b*, 18*c*, and 18*d* are adapted to hold only one golf club.

In a similar fashion, the four outer compartments 18*e*, 18*f*, 18*g*, and 18*h* are formed by creating divider walls 65*a*, 65*b*, 65*c*, and 65*d* hanging from the outer portions of the cross component 42*b* of the frame 18, extending throughout the length of the bag body 12, and terminating at or near the circular bottom fabric piece 51. Each divider wall 65*a*, 65*b*, 65*c*, and 65*d* has an upper section 104 (FIG. 8) which is wrapped around the outer portions of the cross component 42*b* of the frame 18, and then sewn in position along the dotted line 102. Each of the four outer compartments 18*e*, 18*f*, 18*g*, and 18*h* are adapted to hold several golf clubs, typically three.

Figure 8:
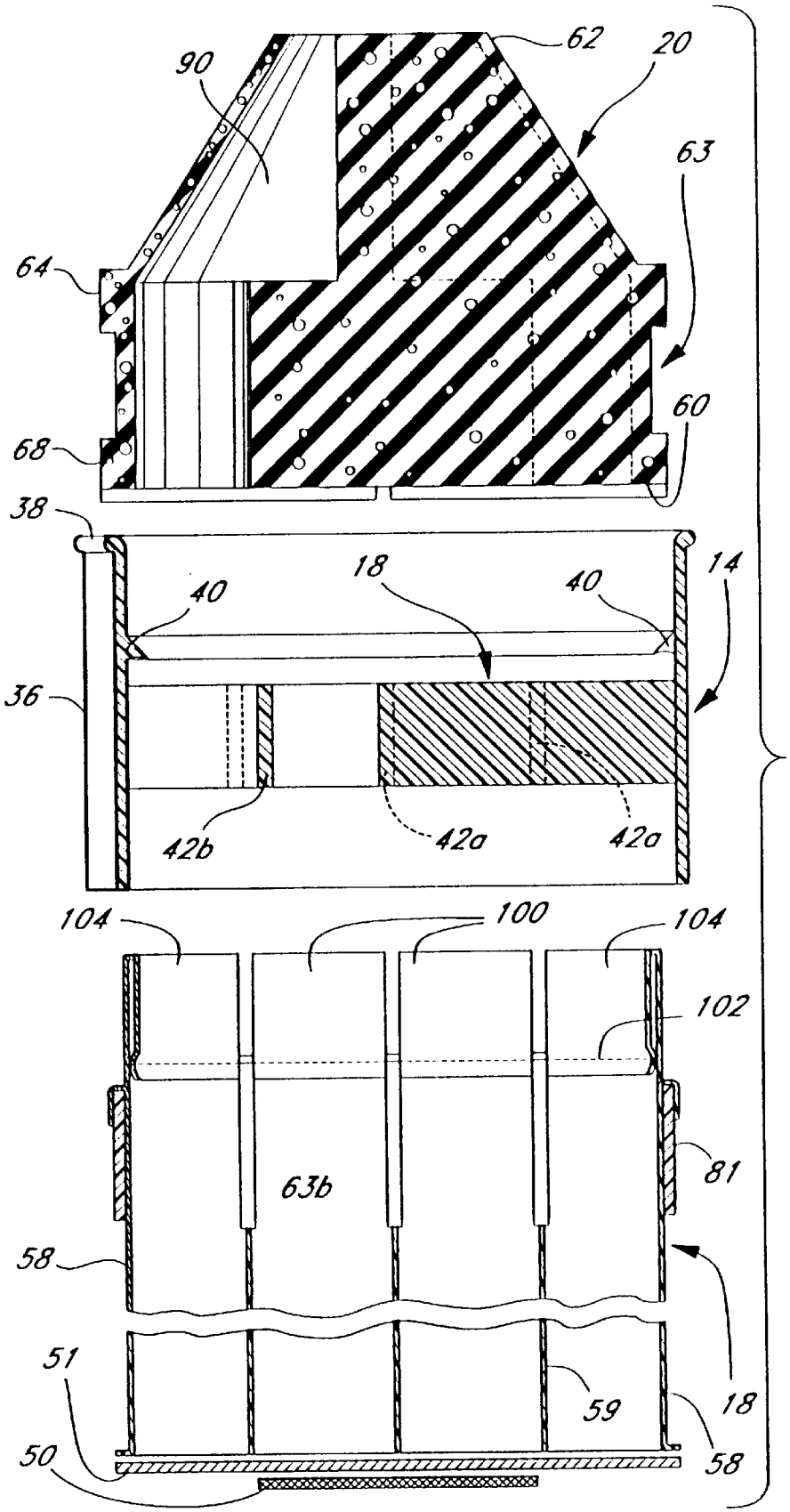

In FIG. 8, the upper portions 100 and 104, respectively, of the divider walls 63*a*, 63*b*, 63*c*, and 63*d* and the divider walls 65*a*, 65*b*, 65*c*, and 65*d* are shown folded over as they would be when wrapped around the inner and outer portions of the cross component 42*b*, but for clarity have been shown folded as they would be when wrapped around the frame 18. The edges of the divider walls 63*a*, 63*b*, 63*c*, 63*d*, 65*a*, 65*b*, 65*c*, and 65*d* are sewn to the outer and inner wall sections 58 and 59, and the walls 63*a*, 63*b*, 63*c*, 63*d* intersect at the center C and are sewn together. The bottom ends of the divider walls 63*a*, 63*b*, 63*c*, 63*d*, 65*a*, 65*b*, 65*c*, and 65*d* are sewn into position to the circular bottom fabric piece 51. The preferred fabric material used in the liner 18 is nylon.

The insert 20 is similar to the insert disclosed in copending U.S. Pat. Nos. 5,624,028 and 5,634,557. The insert 20 is made from a polyurethane foam material with closed cells, rendering the foam material waterproof. The polyurethane foam preferably has a density of no more than 12 pounds per cubic feet. It has an internal end portion 60 and outer end portion 62 which projects from the open mouth of the cavity of the bag body 12.

In outline, the outer end portion 62 has a generally truncated, conical configuration. The internal end portion 60 of the insert 20 has a peripheral wall 63 with two exterior annular shoulders, an upper shoulder 64 and lower shoulder 68. The diameter of the internal end portion 60 of the insert 20 is approximately equal to the inside diameter of the connector section 14, so that this internal end portion 60 fits snugly within the connector section 14. The lower shoulder 68 will interlock with the lip 40 on the side wall of the connector section 14 upon inserting the internal end portion 60 of the insert 20 into the connector section and pushing the lower shoulder beneath the lip.

As best shown in FIG. 7, a cylindrical partition wall 70 forms a central raised, cylindrical section in the insert 20 which is segregated by internal planar partition walls 72 into four approximately equal-sized inner compartments 74, each sized to hold only a single club. These equal-sized compartments 74 are approximately the same size and shape as the four wedge shaped openings 44 formed by the intersection of the cross component 42*a* and circular component 42*b* of the frame 42. As shown in FIG. 3, the underside of the insert 20 has cross channels 80 aligned with the partition walls 72 and a circular channel 82 at the bottom of the cylindrical partition wall 70. These channels 80 and 82 intersect to form a channel configuration which has substantially the same configuration as the frame 42. Thus, when the insert 20 is pushed into the connector section 14 in the open end 16 of the bag body 12, after first aligning these channels with the cross frame component 42*a*, the frame will be received in the channels 80 and 82, when the lower shoulder 68 is beneath the lip 40. This brings the inner compartments 74 of the insert 20 into alignment with the inner compartments 18*a*, 18*b*, 18*c*, and 18*d* of the liner 18. Consequently, when a golf club 22 is placed in an inner compartment 74 of the insert 20, its shaft extends lengthwise downward into an aligned inner compartment of the liner 18.

Partition walls 90 extending between the peripheral wall 63 and the cylindrical wall 70 segregate the outer or circumferential portion of the insert 20 into separate, outer, circumferential compartments 92, each sized to hold only a single club. Each of these outer compartments 92 includes a gripper element 94 made of a polymeric material that does not damage graphite shafts. For example, a solid polyurethane material may be used to form the gripper elements 94 separately from the remaining body of the insert 20. Using conventional insert molding techniques, these gripper elements 94 are them placed into a mold for making the remaining body of the insert 20. Each gripper element 94 comprises a pair of fingers 94*a* and 94*b* that spread apart when a shaft of a golf club 22 is pushed between these fingers. These gripper elements 94 will hold the shaft firmly in position so that it does not move substantially, and therefore, will not strike an adjacent shaft extending into the same outer compartment 18*e*, 18*f*, 18*g*, or 18*h* of the liner 18.

This first embodiment of this invention has several desirable features, in particular the manner in which the insert 20 is interlocked at the open end of the golf bag and the design of the liner 18. One disadvantage which this embodiment, however, is that because of its shape it is difficult to remove easily for cleaning.

Second Embodiment

Figure 9:
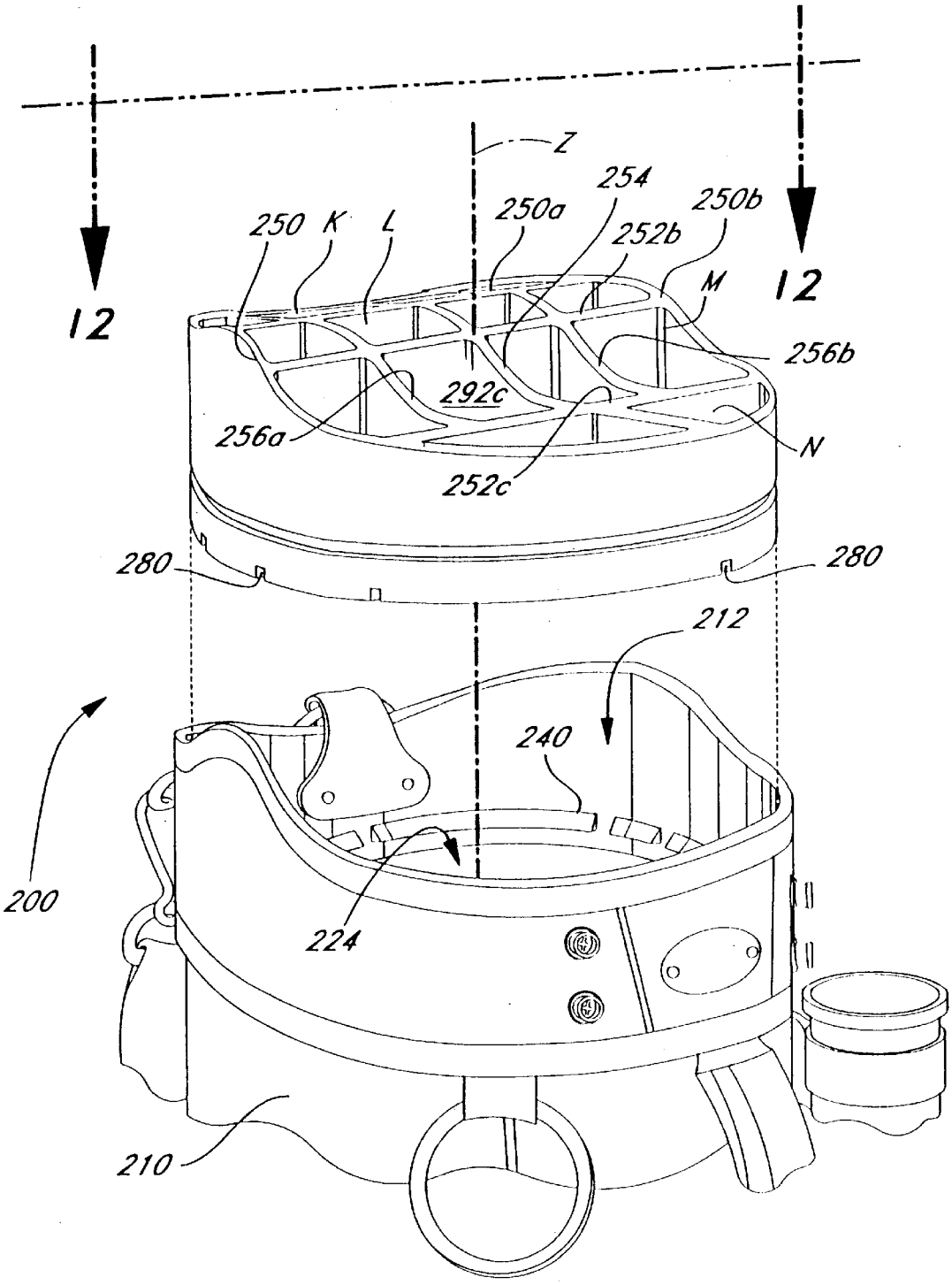
FIGS. 9 through 14 illustrate the second embodiment of this invention where.
Figure 10:
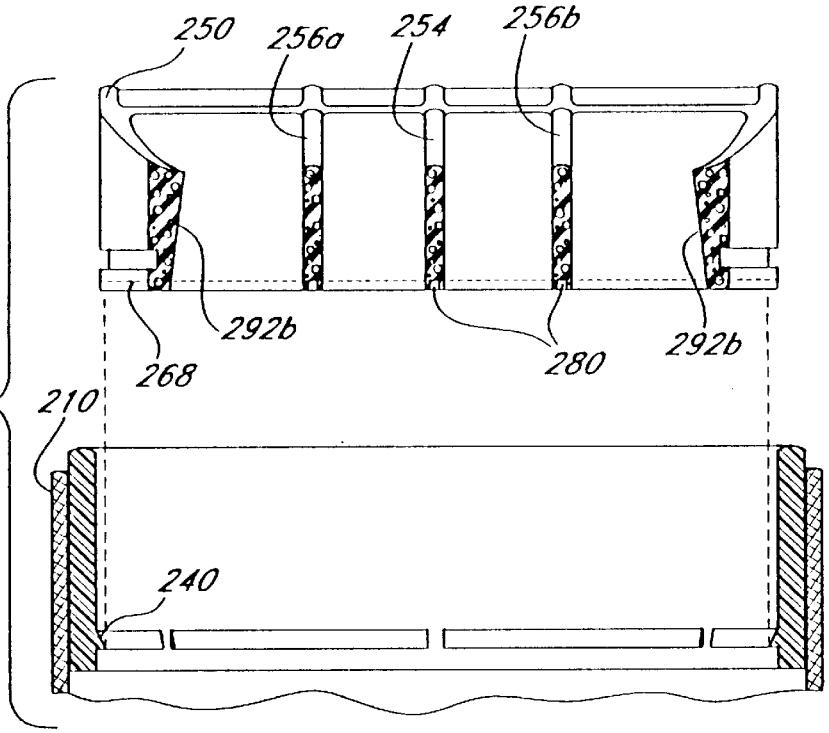
Figure 11:
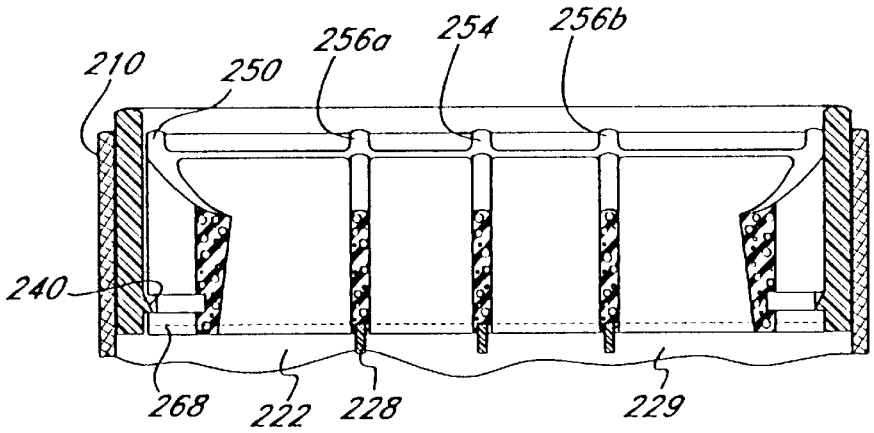
Figure 13:
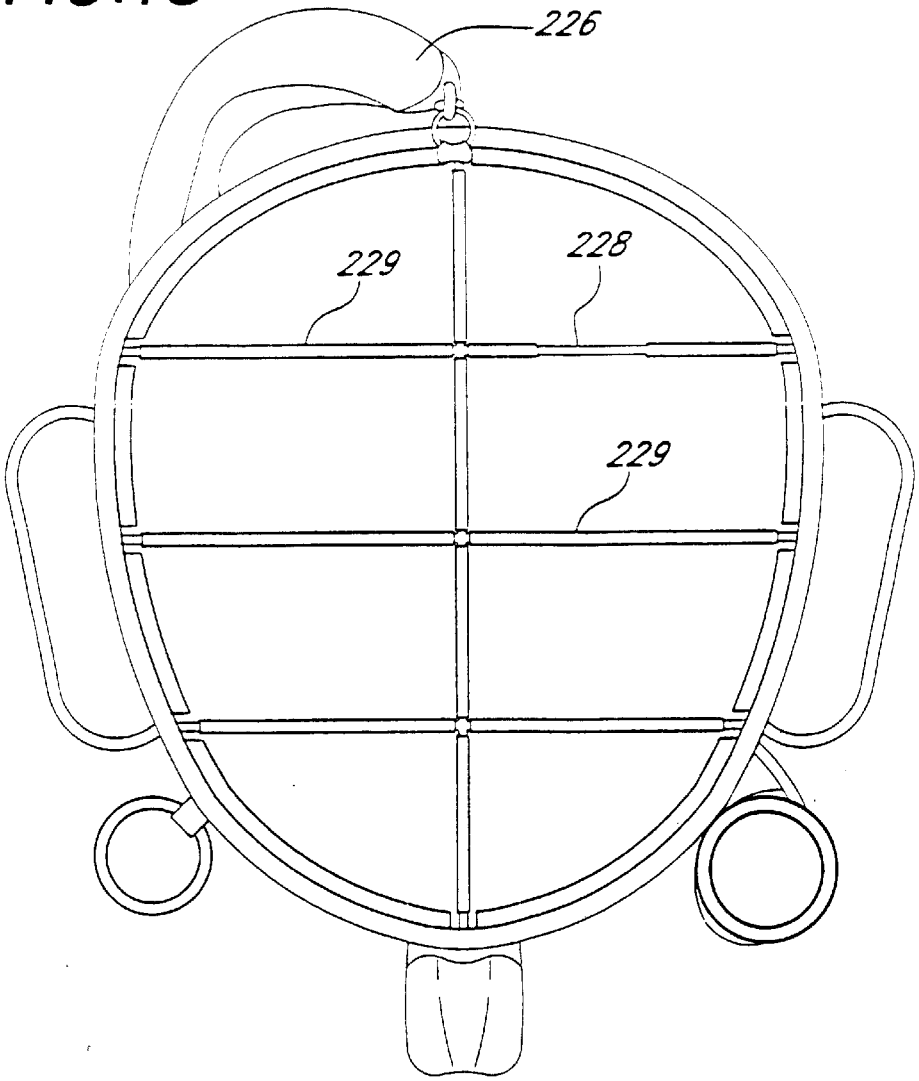

As best illustrated in FIGS. 9, 10, and 11, a golf bag 200 of this invention includes a bag body 210 with an open end 212 and a closed end (not shown) opposite the open end, and an insert 220 of this invention inserted into the open end. The bag body 210 has a liner 222 similar to that of the first embodiment inside a cavity 224 of the bag body 210. The liner 222 has one end near the open end 212 and the other end near the closed end of the golf bag 200. The golf bag 200 includes a strap 226 with a strap connection piece 226*a* attached to the open end 212 of the golf bag 200. The liner 222 includes a frame 228 (FIGS. 11 and 13) over which fabric 229 is draped to form a plurality of compartments (not shown) within the cavity 224 of the golf bag 200 body, which receive the grip ends of the golf club shafts inserted through the insert 220 into the cavity 224 of the bag body 210. There are channels 280 into which the frame 228 fits when the insert 220 is inserted into the open end 212 of the bag body 210.

Inside the open end 212 of the bag body 210 is one element, a lip 240, similar to lip 40 of the first embodiment, of a two-element locking mechanism for the insert 220. The second element of this locking mechanism is a lower shoulder 268 on the exterior of the the insert 220. This shoulder 268 will interlock with the lip 40 upon inserting the lower end of the insert 220 into the cavity 224 and pushing the shoulder beneath the lip. The frame 228 supports the insert 220 upon being placed into the open end 212 of the bag body 210. In accordance with this invention, the insert 220 is designed do that it may be easily deformed for removal.

Figure 12:
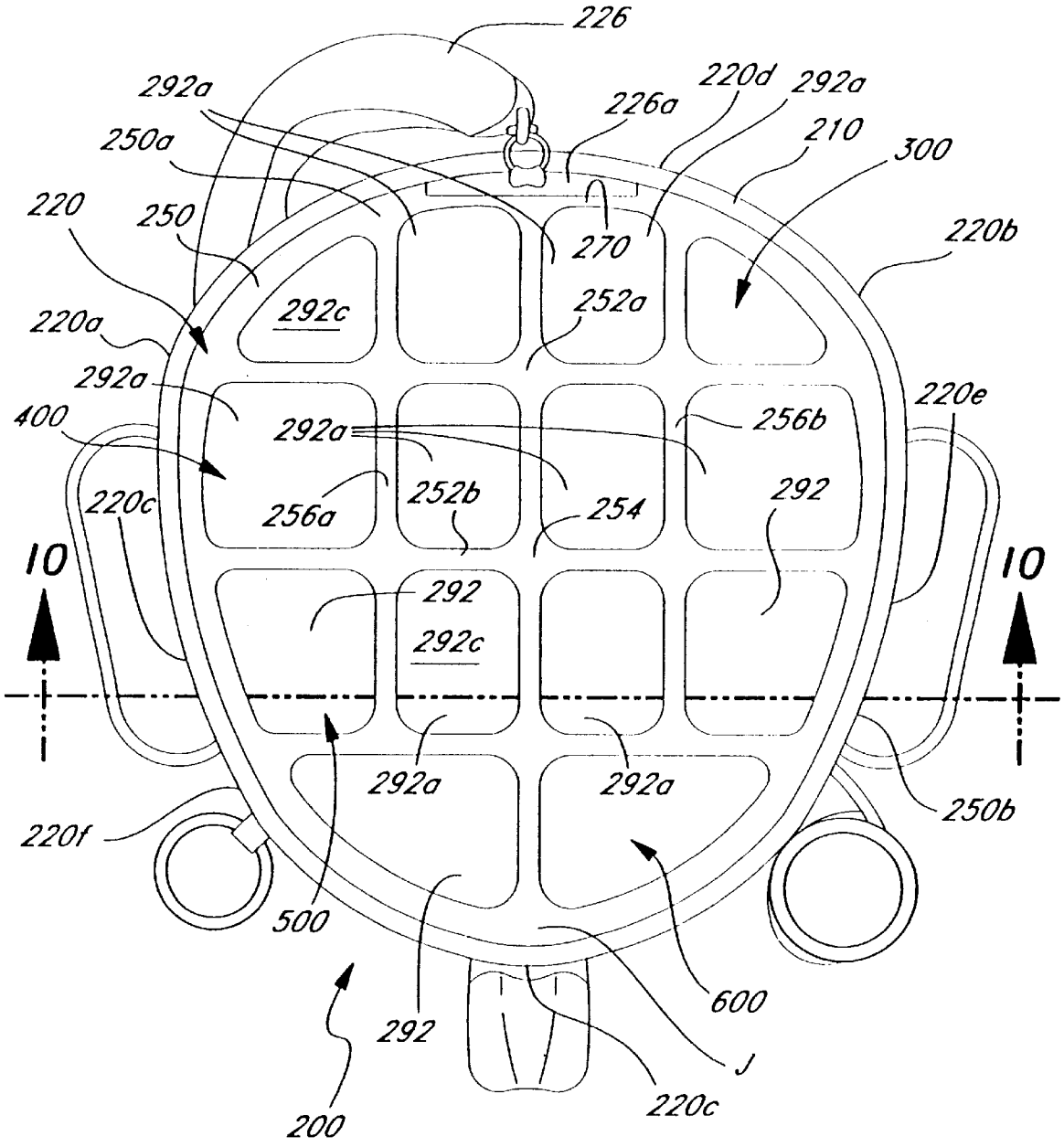
Figure 14:
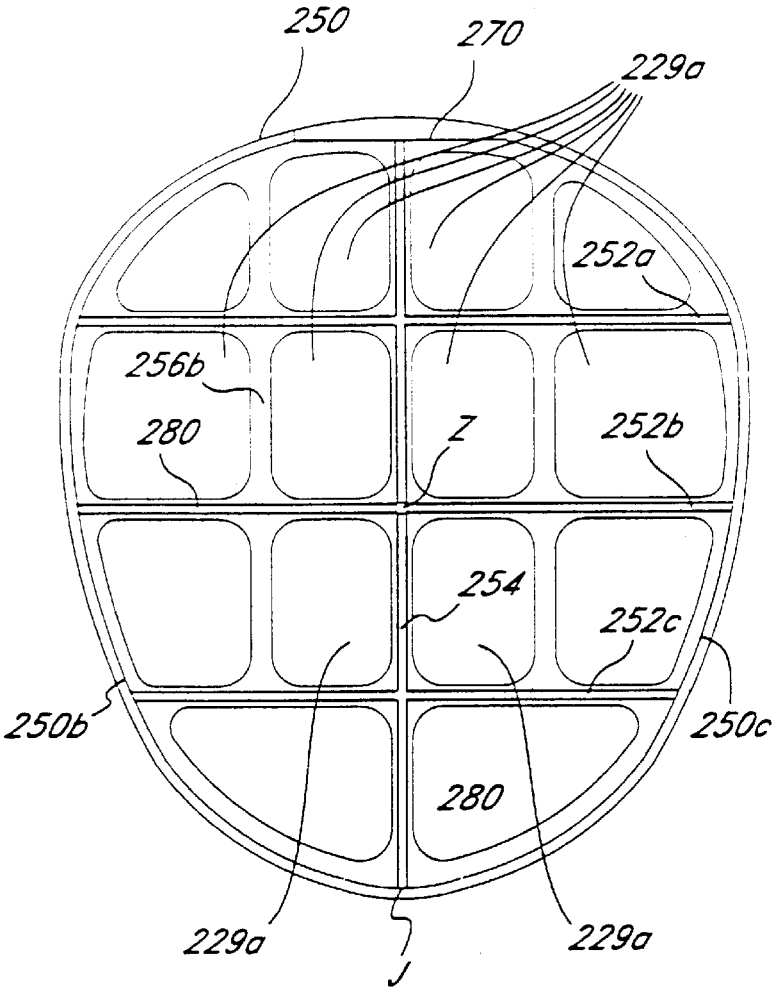

As best shown in FIGS. 12 and 14, the insert 220 has a generally triangular configuration with rounded corners 220*a*, 220*b*, and 220*c* and outwardly bowed sides 220*d*, 220*e*, and 220*f*. It is a unitary structure made b y conventional molding processes using a polyurethane foam which is soft, pliable, deformable, and resilient. The insert 220 has an exterior peripheral wall 250 with opposed side portions 250*a*, 250*b*, 250*c*. There are three internal walls 252*a*, 252*b*, and 252*c* spaced apart from each other and extending between the opposed side portions 252*b* and 252*c*. These three walls 252*a*, 252*b*, and 252*c* are parallel, and the distance between the internal walls 252*a* and 252*b* is approximately equal to the distance between the walls 252*b* and 252*c* . This distance is approximately 2.0 inches, ranging from 1.75 to 2,25 inches depending on the size of the insert 220.

A central internal wall 254 is disposed substantially at a right angle with respect to the three internal walls 252*a*, 252*b*, and 252*c*. This central internal wall 254 extends between the side portion 250*a* and a junction j where side portions 250*b* and 250*c* converge. There are two intermediary walls 256*a* and 256*b* which intersect with the three internal walls 252*a*, 252*b*, and 252*c*. The one intermediary wall 256*a* is on one side of the central internal wall 254, and is spaced from this central internal wall. The second intermediary wall 256*b* is on the other side of the central internal wall 254. These two intermediary walls 256*a* and 256*b* are equidistant from central internal wall 254, approximately a distance of, for example, 1.5 inches. These intermediary walls 256*a* and 256*b* are substantially parallel to each other and to the central internal wall 254, and they extend from the one side portion 250*a* of the peripheral wall 250 and intersect the internal walls 252*a* through 252*c* at substantially a right angle. These intermediary walls 256*a* and 256*b*, each have one end terminating at the side portion 250*a*, and another end terminating at the internal wall 252*c*. This internal wall 252*c* is the furthest from the side portion 250*a*.

The peripheral wall 250, internal walls 252*a*, 252*b*, and 252*c*, central internal wall 254, and intermediate walls 256*a* and 256*b* form four rows 300, 400, 500, and 600 of receptacles 292 into which the shafts of the golf clubs are placed. Three of these rows 300, 400, and 500, each have four receptacles therein, and the fourth row 600 has two receptacles 292 therein. The centrally located receptacles 292*a* have a generally rectangular shape with a width of about 1.5 inches and a length of about 2.0 inches, typically ranging from a width of from 1.25 to 1.75 and a length of from 1.75 to 2.25 depending on the area of the open end 212. The outer surface of the exterior peripheral wall 250 has an indentation 270 therein which provides a space for the strap connection piece 226*a*. As best illustrated in FIG. 10, the inside walls 292*b* of the receptacles 292 have inwardly tapered segments which reduce the likelihood of interference with the grips on shafts of golf clubs as a golf club is withdrawn from a receptacle 292.

In the preferred embodiment, the exterior peripheral wall 250 has a generally triangular configuration with rounded corners. This peripheral wall encloses an area of approximately 60 square inches, and a total area of open space provided by the entry-exit ends of the receptacle is approximately 42–50 square inches, or in excess of 70 percent of the total surface area. This construction, plus the use of a soft, pliable, deformable, resilient foam makes it very easy for the user to simply grasp with his or her hands the insert 220 and deform it to disengage the lip 240 and shoulder 268 the locking mechanism.

The top surface of the insert 220 has four substantially planar zones K, L, M, and N. Each one of the four rows 300, 400, 500, 600 of receptacles 292 is located, respectively, in one of the planar zones, with an entry-exit end 292*c* of each receptacle lying in one of the planar zones. The first planar zone K slants upward from the one side portion 250*a* of the peripheral wall 250 at an angle of about 25 degrees with respect to the longitudinal axis X. This first planar zone K terminates at the second planar zone L, which provides a rounded apex region. The third planar zone M is on the opposite side of this apex region of the second planar zone L. This third planar zone M slants downward from the apex region at an angle of approximately 25 degrees with respect to the central longitudinal axis. The second planar zone is at substantially a right angle varying, plus or minus about 5–10 degrees, with respect to the longitudinal axis X. The third planar zone L terminates at the fourth planar zone N, which has an outer edge terminating at the side portions 250*b* and 250*b* of the peripheral wall 250 nearby the junction j which is opposite the side portion 250*a* This fourth planar zone N is at substantially a right angle with respect to the central longitudinal axis Z. The first planar K is above the fourth planar zone N. The apex region of the second planar zone L is about 3.5 inches from the underside of the insert 220.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. An insert for a golf bag which is adapted to be removably inserted into an open end of the golf bag, including a unitary wall structure which fits snugly within said open end upon insertion of the unitary wall structure into said open end, said unitary wall structure having a central longitudinal axis and (a) a peripheral wall with opposed side portions, (b) first, second, and third internal walls spaced apart substantially parallel to each other and extending between opposed side portions of the peripheral wall, (c) a central internal wall which is disposed substantially at a right angle to said first, second, and third internal walls and extending between opposed side portions of the exterior peripheral wall, and (d) first and second intermediate walls, the first intermediate wall disposed on one side of the central internal wall and spaced from said central internal wall and the second intermediate wall disposed on the other side of the central internal wall and spaced from said central internal wall, said first and second intermediate walls being substantially parallel to each other and to said central internal wall and extending from a first side portion of the peripheral wall and intersecting the first, second, and third internal walls at substantially a right angle, said first and second intermediate walls each having one end terminating at said first side portion of the peripheral wall and another end terminating at the third internal wall, said third internal wall being furthest from said first side portion, said walls forming four rows of receptacles into which the shafts of golf clubs are placed, three of said rows each having four believes that the rejections based on 35 USC 102 and 35 USC 103 are unfounded.

2. The golf bag insert of claim 1 where the majority of said receptacles have a substantially rectangular configuration.

3. The golf bag insert of claim 1 where the walls are formed from a polymeric material by a molding process.

4. The golf bag insert of claim 3 where the polymeric material is a soft, pliable polyurethane foam.

5. The golf bag insert of claim 1 where the first and second intermediate walls are approximately equidistance from the central internal wall.

6. The golf bag insert of claim 1 including a first element of a two-element locking mechanism which interlocks upon insertion of the insert into the open end of the golf bag with a second element of said two-element locking mechanism located at said open end.

7. The golf bag insert of claim 6 where said unitary wall structure is made of a material which is deformable and resilient, enabling a user to grip the unitary wall structure and deform it to disengage the first and second elements of said two-element locking mechanism and remove the unitary wall structure from said open end.

8. The golf bag insert of claim 1 where the peripheral wall has an outer surface with an indentation therein providing a space for a strap connection on the golf bag.

9. The golf bag insert of claim 1 where the receptacles are formed by wall members having inwardly tapered segments which reduce the likelihood of interference with grips on shafts of golf clubs as a club is withdrawn from a receptacle.

10. The golf bag insert of claim 1 where the peripheral wall has a generally triangular configuration with rounded corners and outwardly bowed sides.

11. The golf bag insert of claim 1 where the distance between the first and second internal walls is approximately equal to the distance between the second and third internal walls.

12. An insert for a golf bag which is adapted to be removably inserted into an open end of the golf bag, including a unitary wall structure which fits snugly within the open end upon insertion of the unitary wall structure into said open end, said unitary wall structure having a central longitudinal axis and a plurality of walls arranged to form four rows of receptacles, including first, second, and third rows in sequence, each said first, second, and third rows having four receptacles therein, with the fourth row having a pair of receptacles therein, said unitary wall structure having (a) a generally triangular configuration with rounded corners and outwardly bowed sides, and (b) including a first element of a two-element locking mechanism which upon insertion of the insert into the open end of the golf bag interlocks with a second element of said two-element locking mechanism located at said open end, (c) being formed from a polymeric material which is a soft, pliable, deformable and resilient, enabling a user to grip the unitary wall structure and deform it to disengage the first and second elements of the two-element locking mechanism and remove the unitary wall structure from said open end, and (d) having a top surface with first, second, third, and fourth planar zones, the first planar zone slanting upward from a first side portion of the peripheral wall and terminating at the second planar zone, said second planar zone providing an apex region with the third planar zone slanting downward from the apex region and terminating at the fourth planar zone., said fourth planar zone having an outer edge terminating at a second side portion of the peripheral wall which is opposite said first side portion.

13. The golf bag insert of claim 12 where the first planar zone is at an angle of from 20 to 35 degrees with respect to said central longitudinal axis, the second planar zone is substantially at a right angle with respect to said central longitudinal axis, the third planar zone is at an angle of from 20 to 35 degrees with respect to said central longitudinal axis, and second planar zone is substantially at a right angle with respect to said central longitudinal axis.

14. A golf bag including a bag body having an open end, one element of a two-element locking mechanism at said open end of the bag body, and an insert which is soft, pliable, deformable and resilient material at said open end of the golf bag, said insert fitting snugly within said open end and having a plurality of receptacles for golf clubs therein and including the other element of the two-element locking mechanism, upon insertion of the insert into the open end of the golf bag said elements interlocking, and said insert upon being deformed, disengaging said elements for removal of the insert from said open end, said insert having a peripheral wall enclosing an area of from 50 to 70 square inches, and the receptacles providing an open space with a total area of from 35 to 60 square inches.

15. An insert for a golf bag which is adapted to be removably inserted into an open end of the golf bag, including a unitary wall structure which fits snugly within the open end upon insertion of the unitary wall structure into said open end, said unitary wall structure having a central longitudinal axis and a plurality of walls arranged to form four rows of receptacles, including first, second, and third rows in sequence, each said first, second, and third rows having four receptacles therein, with the fourth row having a pair of receptacles therein, said unitary wall structure having (a) a generally triangular configuration with rounded corners and outwardly bowed sides, and (b) including a first element of a two-element locking mechanism which upon insertion of the insert into the open end of the golf bag interlocks with a second element of said two-element locking mechanism located at said open end, and (c) being formed from a polymeric material which is a soft, pliable, deformable and resilient, enabling a user to grip the unitary wall structure and deform it to disengage the first and second elements of the two-element locking mechanism and remove the unitary wall structure from said open ends, said unitary wall structure including a peripheral wall enclosing an area of from 50 to 70 square inches, and the receptacles providing an open space with a total area of from 35 to 60 square inches.

16. The golf bag insert of claim 15 where the majority of said receptacles have a substantially rectangular configuration.

17. The golf bag insert of claim 15 where the polymeric material is a polyurethane foam.

18. The golf bag insert of claim 15 where the receptacles are formed by wall members having inwardly tapered segments which reduce the likelihood of interference with grips on shafts of golf clubs as a club is withdrawn from a receptacle.

19. The golf bag insert of claim 15 where the peripheral wall has an outer surface with an indentation therein providing a space for a strap connection on the golf bag.

20. A golf bag including a bag body having an open end and a closed end opposite said open end, a first element of a two-element locking mechanism at said open end of the bag body, a liner member disposed within the bag body with one end near said open end of the bag body and another end near the closed end of the bag body, said liner member providing a plurality of separate compartments adapted to receive the grip ends of shafts of golf clubs to be carried in the golf bag, and an insert at said open end of the golf bag, including a unitary wall structure which fits snugly within said open end, said unitary wall structure having a central longitudinal axis and a plurality of walls arranged to form four rows of receptacles, including first, second, and third rows in sequence, each of said first, second, and third rows having four receptacles therein, with a fourth row having a pair of receptacles therein, said unitary wall structure having a generally triangular configuration with rounded corners and outwardly bowed sides and including a second element of a two-element locking mechanism which upon insertion of the insert into the open end of the golf bag interlocks with the first element of said two-element locking mechanism located at said open end, said unitary wall structure being formed from a polymeric material which is a soft, pliable, deformable and resilient, enabling a user to grip the unitary wall structure and deform it to disengage the first and second elements and remove the insert from said open ends, the majority of said receptacles having a substantially rectangular configuration and said rectangular receptacles being centrally located, and said insert having a peripheral wall which encloses an area of from 50 to 70 square inches, and the receptacles provide an open space with a total area of from 35 to 60 square inches.

21. A golf bag including a bag body having an open end, a first element of a two-element locking mechanism at said open end of the bag body, said first element being in the form of a peripheral lip, an insert which is soft, pliable, deformable and resilient material at said open end of the golf bag, said insert fitting snugly within said open end and having a plurality of receptacles for golf clubs therein and including a second element of the two-element locking mechanism, said second element being in the form of a shoulder which fits beneath the lip upon insertion of the insert into the open end of the golf bag causing said insert to deform to allow the shoulder to pass said lip to interlock the insert to the bag body, and said insert upon being deformed, disengaging said first and second elements for removal of the insert from said open end.

22. The golf bag of claim 21 where the insert has an underside with at least one channel therein and the bag body has at the open end a frame having at least one component extending across the open end of the bag body which supports the insert, said cross component being received within the channel upon insertion of the insert into said open end.

23. An insert for a golf bag which is adapted to be removably inserted into an open end of the golf bag, including a wall structure adapted to fit snugly within said open end upon insertion of the wall structure into said open end and comprising a plurality of walls forming a plurality of substantially rectangular receptacles for golf clubs, said rectangular receptacles arranged in at least four separate rows, said wall structure including a first element of a two-element locking mechanism which interlocks upon insertion of the insert into the open end of the golf bag with a second element of said two-element locking mechanism located at said open end and being formed from a polymeric material which is a soft, pliable, deformable and resilient, enabling a user to grip the unitary wall structure and deform it to disengage the first and second elements of the locking mechanism and remove the insert from said end, and an underside and a top surface with first, second, third, and fourth planar zones, the first planar zone slanting upward from a first side portion of the peripheral wall and terminating at the second planar zone, said second planar zone providing an apex region with the third planar zone slanting downward from the apex region and terminating at the fourth planar zone, said fourth planar zone having an outer edge terminating at a second side portion of the peripheral wall which is opposite said first side portion.

24. The golf bag insert of claim 23 including first, second, and third rows in sequence each having four receptacles therein, with a fourth row having a pair of receptacles therein.

25. The golf bag insert of claim 23 where the distance between the underside of the insert and the second planar zone is at a maximum and the distance between the underside of the insert and the fourth planar zone is at a minimum.

26. A golf bag including a bag body having an open end, an insert adapted to be removably inserted into an open end of the golf bag, including a unitary wall structure which fits snugly within said open end upon insertion of the unitary wall structure into said open end, said unitary wall structure having a central longitudinal axis and (a) a peripheral wall with opposed side portions, (b) first, second, and third internal walls spaced apart substantially parallel to each other and extending between opposed side portions of the exterior peripheral wall, (c) a central internal wall which is disposed substantially at a right angle to said first, second, and third internal walls and extending between opposed side portions of the exterior peripheral wall, and (d) first and second intermediate walls, the first intermediate wall on one side of the central internal wall and spaced from said central internal wall and the second intermediate wall on the other side of the central internal wall and spaced from said central internal wall, said first and second intermediate walls being substantially parallel to each other and to said central internal wall and extending from a first side portion of the exterior peripheral wall and intersecting the first, second, and third internal walls at substantially a right angle, said first and second intermediate walls each having one end terminating at said first side portion of the exterior peripheral wall and another end terminating at the third internal wall, said third internal wall being furthest from said first side portion, said walls forming four rows of receptacles into which the shafts of golf clubs are placed, three of said rows each having four receptacles therein and the fourth row having two receptacles therein, where said peripheral wall encloses an area of from 50 to 70 square inches and has a generally triangular configuration with rounded corners and outwardly bowed sides, and the receptacles provide an open space with a total area of from 35 to 60 square inches and the majority of said receptacles have a substantially rectangular configuration and are formed by wall members having inwardly tapered segments which reduce the likelihood of interference with grips on shafts of golf clubs as a club is withdrawn from a receptacle.

27. The golf bag of claim 26 where the walls are formed from a resilient polyurethane foam.

28. The golf bag of claim 27 having a top surface with first, second, third, and fourth planar zones, each one of the four rows of receptacles being in one of the planar zones and each receptacle having an entry-exit end lying in one of the planar zones, the first planar zone slanting upward from the first side portion of the exterior peripheral wall and terminating at the second planar zone, said second planar zone providing an apex region with the third planar zone slanting downward from the apex region and terminating at the fourth planar zone, said fourth planar zone having an outer edge terminating at a second side portion of the peripheral wall which is opposite said first side portion, said first planar zone being at an angle of from 20 to 35 degrees with respect to said central longitudinal axis, said second planar zone being substantially at a right angle with respect to said central longitudinal axis, said third planar zone being at an angle of from 20 to 35 degrees with respect to said central longitudinal axis, and said second planar zone being substantially at a right angle with respect to said central longitudinal axis.

29. The golf bag of claim 27 including a frame disposed within a cavity in the golf bag and connected near said open end, said frame supporting the insert.

30. The golf bag of claim 29 including a liner member extending from the frame lengthwise downward into the cavity, said liner member having a plurality of liner compartments aligned with the receptacles, so that upon placing a shaft of a golf club into a receptacle and then into the cavity, the shaft is received in one of said liner compartments.

31. The golf bag of claim 29 where the insert has an underside including channels, with the frame being received within the channels upon placing the insert into said open end of the bag body.

32. An insert for a golf bag which is adapted to be removably inserted into an open end of the golf bag, including a unitary wall structure which fits snugly within said open end upon insertion of the unitary wall structure into said open end, said unitary wall structure having a central longitudinal axis and (a) a peripheral wall with opposed side portions, (b) first, second, and third internal walls spaced apart substantially parallel to each other and extending between opposed side portions of the peripheral wall, (c) a central internal wall which is disposed substantially at a right angle to said first, second, and third internal walls and extending between opposed side portions of the exterior peripheral wall, and (d) first and second intermediate walls, the first intermediate wall disposed on one side of the central internal wall and spaced from said central internal wall and the second intermediate wall disposed on the other side of the central internal wall and spaced from said central internal wall, said first and second intermediate walls being substantially parallel to each other and to said central internal wall and extending from a first side portion of the peripheral wall and intersecting the first, second, and third internal walls at substantially a right angle, said first and second intermediate walls each having one end terminating at said first side portion of the peripheral wall and another end terminating at the third internal wall, said third internal wall being furthest from said first side portion, said walls forming four rows of receptacles into which the shafts of golf clubs are placed, three of said rows each having four receptacles therein and the fourth row having two receptacles therein, a top surface with first, second, third, and fourth planar zones, each one of the four rows of receptacles being in one of the planar zones and each receptacle having an entry-exit end lying in one of the planar zones, the first planar zone slanting upward from the first side portion of the peripheral wall and terminating at the second planar zone, said second planar zone providing an apex region with the third planar zone slanting downward from the apex region and terminating at the fourth planar zone, said fourth planar zone having an outer edge terminating at a second side portion of the peripheral wall which is opposite said first side portion.

33. The golf bag insert of claim 32 where the first planar zone is at an angle of from 20 to 35 degrees with respect to said central longitudinal axis, the second planar zone is substantially at a right angle with respect to said central longitudinal axis, the third planar zone is at an angle of from 20 to 35 degrees with respect to said central longitudinal axis, and said fourth planar zone is substantially at a right angle with respect to said central longitudinal axis.

* * * * *